United States Patent [19]

Watanabe et al.

[11] 4,454,021

[45] Jun. 12, 1984

[54] METHOD FOR THERMAL CRACKING OF HYDROCARBONS IN AN APPARATUS OF AN ALLOY HAVING ALKALI OR ALKALINE EARTH METALS IN THE ALLOY TO MINIMIZE COKE DEPOSITION

[75] Inventors: Yoji Watanabe, Oita; Toshio Morimura, Kawaguchi; Yukio Toyoda, Oita, all of Japan

[73] Assignee: Showa Denko Kabushiki Kaisha, Tokyo, Japan

[21] Appl. No.: 331,782

[22] Filed: Dec. 17, 1981

[51] Int. Cl.[3] ..... C10G 9/12

[52] U.S. Cl. ..... 208/48 R; 208/47; 422/240; 422/241; 585/950

[58] Field of Search ..... 208/48 R, 47; 585/636; 422/240, 241; 585/950; 75/128 E

[56] References Cited

U.S. PATENT DOCUMENTS

| | | | |
|---|---|---|---|
| 3,704,333 | 11/1972 | Spangler et al. | 585/950 |
| 3,827,967 | 8/1974 | Nap et al. | 422/241 |
| 3,839,485 | 10/1974 | Wrisberg et al. | 585/950 |
| 3,919,073 | 11/1975 | Bagnoli et al. | 208/48 R |
| 3,989,514 | 11/1976 | Fujioka et al. | 75/128 E |
| 4,047,875 | 9/1977 | May et al. | 208/47 |
| 4,050,928 | 9/1977 | Crum | 75/128 E |
| 4,102,677 | 7/1978 | Deverell | 75/128 E |
| 4,297,150 | 10/1981 | Foster et al. | 148/6.3 |

FOREIGN PATENT DOCUMENTS

| | | | |
|---|---|---|---|
| 317359 | 8/1929 | United Kingdom | 585/636 |

*Primary Examiner*—Delbert E. Gantz
*Assistant Examiner*—Lance Johnson
*Attorney, Agent, or Firm*—Armstrong, Nikaido, Marmelstein & Kubovcik

[57] ABSTRACT

In the thermal cracking of or heating of hydrocarbons, for example naphtha, a carbonization reaction incidentally takes place due to the fact that Ni, Fe and Co contained in, for example, the conduits of the thermal cracking apparatus have a catalytically carbonizing action. The aim of the present invention is to effectively suppress carbon deposition promoted by these elements, to provide for the incorporation of an inhibitor element, e.g. Li, Na, Ba, Be, Ca, Mg or their oxides, into the heat-resistant alloy, and to form on the surface of this alloy a carbon deposition suppressing layer which comprises an inhibitor element.

18 Claims, 2 Drawing Figures

Figure 1:
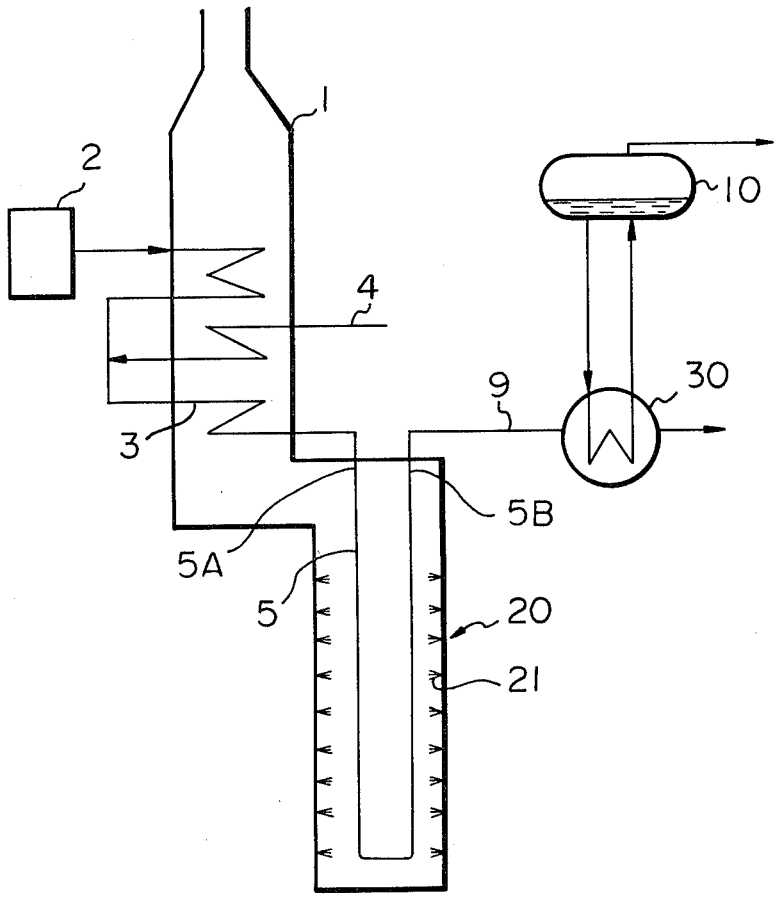

METHOD FOR THERMAL CRACKING OF HYDROCARBONS IN AN APPARATUS OF AN ALLOY HAVING ALKALI OR ALKALINE EARTH METALS IN THE ALLOY TO MINIMIZE COKE DEPOSITION

The present invention relates to a method and apparatus for thermal cracking of or heating of hydrocarbons. More particularly, it relates to the suppression of carbon deposition on the surface of a heat-resistant alloy member of a thermal cracking or heating apparatus. In addition, the present invention relates to a heat-resistant alloy used as a member of the apparatus mentioned above.

As is well-known, the thermal cracking of or heating of hydrocarbons, such as naphtha, ethane, and gas oil, and the like, is conventionally carried out. In regard to the thermal cracking of and heating of hydrocarbons, carbon deposition is likely to occur on the heat-resistant alloy member of an apparatus for thermal cracking or heating due to the carbonization reaction of hydrocarbons which are heated to a high temperature, which reaction incidentally takes place during the thermal cracking of or heating of the hydrocarbons. As is also well-known, such a carbonization reaction takes place on the surface of a thermal cracking tube or a thermal cracking chamber or heating chamber of the apparatus mentioned above because iron, nickel, or cobalt contained in the heat-resistant alloy member of the apparatus has a catalytically carbonizing action and thus promotes the carbonization reaction of hydrocarbons.

Examples of heat-resistant alloys frequently used as the heat-resistant alloy member of a thermal cracking or heating apparatus are given in the following table.

TABLE 1

| | Heat-resistant Alloys | | | | | | | | | | | |
|---|---|---|---|---|---|---|---|---|---|---|---|---|
| | C | Si | Mn | P | S | Ni | Cr | Mo | Al | Ti | Cu | Fe |
| HK-40 | 0.43 | 1.08 | 1.20 | 0.015 | 0.016 | 20.22 | 26.05 | 0.01 | — | — | — | Bal |
| H P | 0.37 | 1.50 | 1.33 | 0.012 | 0.008 | 34.70 | 25.40 | 0.06 | — | — | — | Bal |
| Incolloy 800 | 0.05 | 0.5 | 0.8 | — | 0.008 | 32.5 | 21.0 | — | 0.4 | 0.4 | 0.4 | Bal |

Chromium, contained in the three alloys given in Table 1 above, is an indispensable element which renders the alloys corrosion-resistant and heat-resistant. Nickel and molybdenum mainly give the alloys a high-temperature strength.

Small amounts of carbon, silicon, and manganese are contained in these alloys mainly for the purpose of additionally enhancing their high-temperature strength. The three alloys given in Table 1 are ferrous alloys or heat-resistant steels. However, heat-resistant alloys free from iron or containing only a very small amount or iron, such as Inconel 706,702 and S 816, can be used to construct, for example, a thermal cracking apparatus.

A number of heat-resistant alloys have been proposed for improving high-temperature strength, corrosion-resistance and heat-resistance. However, no alloys which suppress carbon deposition have been proposed as far as the present inventors are aware. In order to suppress carbon deposition by promoting a water-gas reaction in an apparatus for thermal cracking of or heating of hydrocarbons, a large amount of steam conventionally has been added to the hydrocarbons being cracked or heated, thereby suppressing carbon deposition to a certain degree. However, the degree of suppression is still not sufficient to satisfactorily prevent carbon deposition.

A conventional apparatus for thermal cracking of hydrocarbons is explained with reference to FIG. 1.

Figure 2:
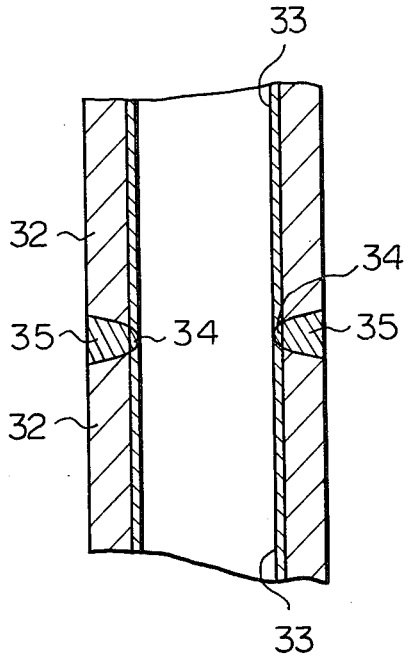

In the drawings,

FIG. 1 schematically illustrates an apparatus for thermal cracking of naphtha and the like, and FIG. 2 schematically illustrates a section of a tubular heat-resistant alloy member.

The apparatus of thermal cracking of naphtha, which is used to produce ethylene, propylene and the like comprises a convection chamber 1 and a radiation chamber 20. A preheating conduit 3 is communicated with the source 2 of naphtha. The naphtha is mixed with steam, which is preheated during its passage through a steam conduit 4 in the convection chamber 1. The preheating conduit 3 and the steam conduit 4 can therefore recover waste heat which is generated in the radiation chamber 20 and is transported to the convection chamber 1. The steam in the steam conduit 4 is mixed with the naphtha and heats the naphtha to a temperature of from 500° to 600° C. The naphtha, which is mixed with the steam and thus diluted, is then introduced into the radiation chamber 20 and is caused to flow through a thermal cracking reaction conduit 5. The radiation chamber 20 is equipped with a number of burners 21. The naphtha, which has been preheated in the convection chamber 1, is cracked in the thermal cracking reaction conduit 5. The thermal cracking reaction conduit 5 is communicated with a heat recovery device 30 so as to conduct the heat at a temperature of from 800° to 900° C. to superheated water which is fed from a stream drum 10 and is then reverted to the steam drum 10. The thermal cracking reaction conduit 5, the preheating conduit 3, the heat recovery device 30, which is located downstream of the radiation chamber 20, and an intermediate conduit 9 are heated to a temperature higher than the other members (4 and 10) of the apparatus for thermal cracking of naphtha. Therefore, the heat-resistant alloys given in Table 1 for example are used to construct the thermal cracking reaction conduit 5, the preheating conduit 3, the intermediate conduit 9 and the hydrocarbon conduit (not shown) of the heat recovery device 30. While the naphtha is being transported through the thermal cracking reaction conduit 5, said naphtha, which has been preheated and diluted by steam, is further heated due to radiation heat from the burners 21 so that it is cracked into ethylene, propylene and the like. The burners 21 are controlled so as to realize an appropriate thermal cracking temperature which corresponds to a temperature of from 800° to 900° C. measured at the outlet portion 5B of the thermal cracking reaction conduit 5 positioned on the wall of the radiation chamber 20.

While the naphtha is being preheated or cracked as stated hereinabove, the carbonization reaction incidentally takes place. As a result of the carbonization reaction, carbon is deposited on the inner walls of the various conduits and grows to such an extent that the rate of conduction of heat in these conduits is considerably decreased due to the carbon layer formed around the inner walls of said conduits. In order to ensure that the naphtha is cracked at a constant temperature within the thermal cracking reaction conduit 5, the amount of combustion of the burners 21 must be increased and the outer wall temperature of the thermal cracking reaction conduit 5 must be gradually elevated so as to compensate for the decrease in the rate of conduction of heat. According to an example of increasing the amount of combustion in the burners, the outer wall temperature of the thermal cracking reaction conduit 5 in the range of from 900° to 1000° C. locally at the beginning of thermal cracking of the naphtha is enhanced to within the range of from 1000° to 1050° C. during the cracking process. However, when the outer wall temperature reaches a temperature range of from 1000° to 1050° C., thermal cracking of the naphtha cannot be continued any longer due to the fact that cracking at a high temperature is disadvantageous from an economical point of view, and, further, the heat-resistant alloy of the thermal cracking reaction conduit 5 is not highly resistant at such a high temperature. The process of thermal cracking of naphtha is therefore interrupted and carbon removal or decoking is carried out.

There are two known decoking methods for carbon removal. According to one of the decoking methods, which is referred to as steam decoking, steam is introduced into the thermal cracking reaction conduit 5 at a temperature of from 900° to 950° C. measured at the outlet portion 5B. According to the other decoking method, which is referred to as steam-air decoking, steam and air are introduced into the thermal cracking reaction conduit 5 at a temperature of from 700° to 900° C. measured at the outlet portion 5B. The period during which thermal cracking of naphtha can be continued without decoking is from 40 to 60 days. In other words, interruption of the thermal cracking process every 40 or 60 days so as to carry out decoking is unavoidable. Approximately one or two days are required for decoking, resulting in a decrease in the amount of ethylene, propylene, etc. produced. In addition, in the case of decoking not only must an enormous amount of steam be used but an amount of full sufficient to heat the thermal cracking reaction conduit 5 must also be used.

Up to now, various attempts have been made to suppress carbon deposition, thereby making long-term continuous thermal cracking of naphtha possible. According to one of the attempts, disclosed in German Offenlegungsschrift No. 27 50 324, one or more sulfide, sulfate or thiosulfate of alkali metals or alkaline earth metals are incorporated into the raw material, i.e. hydrocarbons, as inhibitors. The alkali metals or alkaline earth metals of sulfide and the like promote a water-gas reaction, while the anion of sulfide and the like inhibit the carbonization reaction. The method of incorporating the inhibitors into the raw material involves a side effect, that is, the members or devices of a thermal cracking apparatus are subjected to corrosion due to the inhibitors, which flow downstream. In addition, it is necessary to take measures to remove the inhibitors from the product since the inhibitors contaminate the product. This is a disadvantage of the inhibitor-incoporating method.

Japanese Laid-open Patent Application No. 2601/1972 discloses how to prevent carbon deposition caused by the catalytically carbonizing action of nickel and iron of heat-resistant alloys by applying a coating consisting of gold or a gold-copper alloy around the inner wall of a thermal cracking reaction conduit and the like. However, it is difficult to apply a coating around the inner wall of a thermal cracking reaction conduit.

In addition, U.S. Pat. No. 3,827,967 discloses the flowing of molten metal which does not have a catalytically carbonizing action, into a thermal cracking reaction conduit, thereby isolating the hydrocarbons being thermally cracked from the inner wall of the conduit. However, the flowing of the molten metal into the thermal cracking reaction conduit involves a complicated process. Previous attempts to prolong the period of thermal cracking have been carried out mainly with the objective of isolating the hydrocarbons from the metals or elements having a catalytically carbonizing action but have not dealt with suppression of carbon deposition by promoting a catalytic water-gas reaction by a heat-resistant alloy member itself. Therefore, the present inventors carried out research in an attempt to improve the properties of heat-resistant alloys and thereby lessen or suppress carbon deposition caused by the catalytically carbonizing action of these alloys.

It is an object of the present invention to provide a method for thermal cracking of or heating of hydrocarbons which involves a more economical and simpler process than do the known methods.

It is another object of the present invention to provide a heat-resistant alloy capable of promoting a water-gas reaction and thus suppressing carbon deposition.

It is yet another object of the present invention to provide an apparatus for thermal cracking of or heating of hydrocarbons, which involves a more economical process as compared with that of known apparatuses.

In accordance with the objects of the present invention, there is provided a method for thermal cracking of or heating of hydrocarbons while suppressing carbon deposition on the surface of a heat-resistant alloy member of a thermal cracking or heating apparatus, characterized in that at least one element selected from the group consisting of an alkali metal, an alkaline earth metal and an alkali metal-oxide and an alkaline earth metal oxide is incorporated into at least a part of said heat-resistant alloy member, where the carbon deposition occurs, thereby effectively suppressing carbon deposition.

The alkali metal is preferably at least one element selected from the group consisting of lithium, sodium and potassium and the alkaline earth metal is preferably at least one element selected from the group consisting of calcium, barium, beryllium and magnesium.

At least one element mentioned above is hereinafter referred to as the inhibitor element. A discovery made by the present inventors is that a small amount, i.e. 3%, preferably 0.1% at the highest, of the inhibitor element incorporated into the heat-resistant alloy member as a solid solution or dispersed phases can considerably suppress carbon deposition promoted by the catalytically carbonizing action of nickel, cobalt and/or iron. However, as is well-known, the largest part of nickel, cobalt, and iron constitutes the matrix of heat-resistant alloys usually in the form of a solid solution. These metals have a catalytically carbonizing action as stated above. Surprisingly, the inhibitor element, which is contained in the heat-resistant alloy in an amount considerably smaller than the amount of nickel and the like, can suppress appreciably carbon deposition promoted by the catalytically carbonizing action.

Depending upon the major components of the heat-resistant alloy, said alloy can be embodied as: a nickel-chromium alloy which usually contains from 7 to 85% of nickel and from 6 to 70% of chromium; a molybdenum-chromium alloy which usually contains from 0.4 to 4% of molybdenum and from 12 to 35% of chromium; a chromium-cobalt alloy which usually contains from 0 to 30% of chromium and from 0 to 35% of nickel, the balance being essentially cobalt; a nickel chromium steel which usually contains from 3 to 35% of nickel, from 16 to 28% of chromium and from 35 to 74% of iron; and a chromium-molybdenum steel which usually contains from 0.5 to 10% of chromium, from 0.4 to 1.1% of molybdenum and from 88 to 97% of iron.

The heat-resistant alloy may contain, in addition to the inhibitor element and major components, small amounts of optional elements such as carbon, silicon, manganese, aluminum, titanium, niobium, phosphorus, sulfur, boron, zirconium, tantalum, cerium, vanadium and the like, all of which are unavoidable impurity elements or elements capable of mainly enhancing high-temperature strength. Usually, the carbon content is from 0.04 to 4%, the manganese content is from 0.5 to 2%, and the silicon content is from 0.5 to 2%. The total amount of the optional elements does not exceed 10%.

The minimum content of the inhibitor element is preferably 0.0005%, more preferably 0.001%.

The above-mentioned heat-resistant alloy can be produced basically by means of a known melting process. However, the following procedures are recommended because recovery of the inhibitor element in the heat-resistant alloy is not very high and further the inhibitor element should be uniformly dispersed in the alloy.

The alkaline earth metal and lithium should be added to the alloy melt of, for example, heat-resistant steels which have been adequately deoxidized. A silicon alloy or aluminum should be used as a deoxidizing agent. The alloys, e.g. heat-resistant steels, should be melted in an inert gas atmosphere.

Sodium and potassium cannot be incorporated into an alloy melt at an acceptably high recovery because their vapor pressure is high. Therefore, a potassium-silicon alloy or a sodium-silicon alloy having a eutectic composition is prepared so as to reduce the vapor pressure of these alloys to less than that of metallic sodium or metallic potassium. Deoxidation and melting in an inert gas atmosphere, as stated above, are necessary in order to incorporate sodium and potassium into an alloy melt.

An aluminum-lithium alloy can be used to incorporate lithium into an alloy melt.

Oxides of an alkali metal or an alkaline earth metal can be uniformly and finely distributed in an alloy melt when these oxides or a carbonate of an alkali metal or an alkaline earth metal is injected into an alloy melt by means of an inert gas, such as argon gas. This method is referred to as a spray-dispersion method and is desirable for uniform and fine dispersion of the oxides mentioned above. The carbonate is decomposed into an oxide in the alloy melt.

A thermal cracking or heating apparatus can be manufactured using the sheets, plates or tubes of the heat-resistant alloy mentioned above.

Alternatively, the heat-resistant alloy member may be provided on its metallic surface with a layer for suppressing carbon deposition, the layer comprising the inhibitor element. The carbon deposition suppressing layer may consist of a heat-resistant chromium alloy which contains the inhibitor element. Such heat-resistant alloy member provided with the above-mentioned heat-resistant alloy layer on its inner surface can be manufactured by means of a clad method when this member is in sheet form. When this member is in tubular form, it can be produced by means of a dual tube method. Namely, a heat-resistant alloy tube, which does not contain the inhibitor element, and a core are concentrically disposed to define an annular clearance or mold space therebetween, and the melt of the heat-resistant alloy containing the inhibitor element is poured into the annular clearance and is then solidified. The so-produced tube is a dual concentric tube which consists of an outer tube or base and an inner tube containing the inhibitor element. In the dual tube method, centrifugal casting is usually carried out.

A hot-press method may be employed for the production of a dual tubular heat-resistant alloy member. Namely, the heat-resistant alloy powder and the particulate inhibitor element are mixed together, the resultant mixture is compressed in tubular form, the compressed tubular body is heated and sintered, and the sintered tubular body is hot die-forged to enhance its density. The thus die-forged body is then tightly inserted into the cylindrical hollow base and is hot-extruded to obtain a dual tubular heat-resistant alloy member.

In the present invention, the inner surface of the thermal cracking or heating apparatus may be metallic; in other words, a coating need not be applied to the inner surface. Alternatively, the carbon deposition suppressing layer mentioned above may consist of a sprayed layer consisting of the inhibitor element only. The sprayed layer may consist of a mixture of the inhibitor element and the heat-resistant alloy. The inhibitor element and heat-resistant alloy in powder form are applied to the base by plasma spraying, arc spraying, gas plasma spraying and the like. The sprayed layer can contain a higher amount of the inhibitor element than can the heat-resistant alloy because the inhibitor element is applied onto the heat-resistant alloy, which has been shaped or worked, and the sprayed layer is thus not required to have good workability. In addition, a high-temperature strength of the heat-resistant alloy member is realized by its body, i.e. the heat-resistant alloy, onto which the sprayed layer is applied, with the result that such elements as nickel, chromium, and cobalt, which provide the heat-resistant alloy with a high-temperature strength, need not be contained in the sprayed layer at a high content. The ratio of the weight of the heat-resistant powder, e.g. a 50% Ni-50% Cr powder, to the inhibitor element powder may be 10:1. The thickness of the carbon deposition suppressing layer may be approximately 100 microns.

An apparatus for thermal cracking of or heating of hydrocarbons, comprising a radiation chamber for cracking the starting hydrocarbons into cracked hydrocarbons, especially ethylene and propylene and the like, a convection chamber communicated with said radiation chamber, a preheating conduit for the starting hydrocarbons extending from the source of the starting hydrocarbons into said convection chamber, a thermal cracking reaction conduit for the preheated starting hydrocarbons located in said radiation chamber, and a heat recovery device communicated with said thermal cracking reaction conduit via an intermediate conduit, characterized in that the inhibitor element is contained in at least the inner part of said thermal cracking reaction conduit, said heat recovery device and said intermediate conduit. The thermal cracking reaction conduit, the hydrocarbon conduit of the heat recovery device, the intermediate conduit of the thermal cracking apparatus and the downstream part of the preheating conduit are exposed to a high temperature of 500° C. or higher and are hereinafter collectively referred to as high-temperature parts. The high temperature parts may consist of a heat-resistant alloy containing the inhibitor element. Alternatively, a carbon deposition suppressing layer may be applied onto the heat-resistant alloy which is free of the inhibitor element.

An embodiment of the apparatus according to the present invention is explained by referring to FIG. 1. The conduit members of the high-temperature parts (3, 5, 9 and 30) comprise a plurality of welded tubular sections made of a heat-resistant alloy, such as HK 40, SUS 304, or STBA 24. A mixture of the heat-resistant alloy powder, e.g. a 50%Ni-50%Cr alloy powder and the inhibitor element powder, is sprayed onto the inner wall of each of the rotating tubular sections 32 (FIG. 2) by means of a plasma spray torch which protrudes into each tubular section. The tubular sections 32 having a sprayed layer 33 are then longitudinally welded to one another, thereby providing the dimensions and configurations necessary for the high-temperature parts. Reference numerals 34 and 35 indicate weld metals. An electrode having a composition similar to the sprayed layer 33 is used so as to form the weld matal 34 in the groove. Parts where carbon deposition does not occur or parts other than the high-temperature parts may consist of material free of the inhibitor element. Such material may be austenitic stainless steels or low alloyed steels. The apparatus of the present invention explained above can be operated under the following conditions:

A. Flow Rate of Naphtha:
15 ton/hour

B. Amount of Steam for Dilution of Naphtha:
7.5 ton/hour

C. Temperature at Inlet (5A in FIG. 1) of Radiation Chamber 20:
600° C.

D. Temperature at Outlet 5B of Radiation Chamber 20:
850° C.

The method of the present invention can be applied to any cracking or heating method employing steam, including the inner- and outer-heating systems.

Examples of the present invention are now explained.

EXAMPLE 1

Alloys were melted in a high frequency induction furnace having a magnesia lining. The alloys had virtually the same compositions as HK 40 given in Table 1 except that they additionally contained the inhibitor element as given in Table 2, below. The alloys were melted in an argon gas atmosphere and were deoxidized with a silicon alloy. Then the inhibitor element in a metallic form was incorporated into the melt, which was then cast into a mold. The resultant ingots were machined so as to obtain tubular sections having an outer diameter of 12 mm, an inner diameter of 10 mm, and a length of 100 mm. The tubular sections were bonded to one another by means of TIG welding so as to obtain tubes (thermal cracking reaction conduits) 800 mm long. Thermal cracking of naphtha was carried out in the resultant tubes under the following conditions:

A. Temperature at Inlet of Thermal Cracking Reaction Conduit: 600° C.

B. Temperature at Outlet of Thermal Cracking Reaction Conduit: 850° C.

C. Flow Rate of Naphtha: 5 kg/hour

D. Flow Rate of Steam for Dilution: 2.5 kg/hour

E. Operation Time: 40 hours

The amount of carbon deposited on the inner walls of the thermal cracking reaction conduits per 100 mm length was measured.

In order to make a comparison, one thermal cracking reaction conduit was produced by using HK 40 free of the inhibitor element.

TABLE 2

| | Amount of Carbon Deposition | | | | | |
|---|---|---|---|---|---|---|
| Run Nos. | Li(wt %) | Ca(wt %) | Ba(wt %) | Be(wt %) | Li + Ca + Ba + Be(wt %) | Amount of Carbon Deposition (g) |
| 1 | — | 0.03 | — | — | 0.03 | 7.3 |
| 2 | — | — | 0.03 | — | 0.03 | 6.5 |
| 3 | — | — | — | 0.03 | 0.03 | 7.8 |
| 4 | — | 0.03 | 0.02 | — | 0.05 | 5.2 |
| 5 | — | 0.03 | 0.02 | 0.03 | 0.08 | 4.0 |
| 6 | — | 0.10 | — | 0.03 | 0.13 | 4.3 |
| 7 | — | 0.04 | 0.07 | | 0.11 | 3.2 |
| 8 | 0.02 | — | — | — | 0.02 | 6.1 |
| 9 (Comparative Example) | — | — | — | — | — | 16.1 |

It is clear from Table 2 that the carbon deposition caused by the catalytically carbonizing action of nickel and iron of HK 40 is suppressed by lithium, calcium, barium or beryllium.

EXAMPLE 2

The procedure used in Example 1 was repeated except that the thermal cracking reaction conduits were produced using an alloy steel for pipe stipulated in JIS STPA25 (chromium-molybdenum alloy steel pipe) and said alloy steel containing 0.03 wt% of barium.

A thermal cracking reaction of $C_4$ fraction of the cut resultant, obtained after the extraction of butadiene, was carried out under the following conditions:

A. Temperature at Inlet of Thermal Cracking Reaction Conduit: 550° C.

B. Temperature at Outlet of Thermal Cracking Reaction Conduit: 750° C.

C. Flow Rate of $C_4$ Fraction: 5 kg/hour

D. Flow Rate of Steam for Dilution: 2.5 kg/hour

E. Operation Time: 80 hours

The amount of carbon deposition in the thermal cracking reaction conduits containing the inhibitor element(Ba) and the amount in those not containing the inhibitor element was 2.1 g and 5 g, respectively.

EXAMPLE 3

An alloy melt of austenitic stainless steel (JIS SUS 310) was prepared in a high-frequency induction furnace and was poured into a mold via a spout opened upward. While the alloy melt was streamed down along the spout, $Na_2CO_3$, $K_2CO_3$, $Li_2O$, CaO, BaO or MgO in particulate form was sprayed onto the alloy melt by means of a spray gun. An argon gas was used as the carrier gas of $Na_2CO_3$ and the like. The resultant alloys were so-called spray-dispersion alloys and contained the inhibitor element in the amounts given in Table 3 below.

The thermal cracking reaction conduits were produced using the spray-dispersion alloys by means of the procedure described in Example 1.

A thermal cracking reaction of $C_4$ fraction of the cut resultant, obtained after the extraction of butadiene, was carried out under the following conditions:

A. Temperature at Inlet of Thermal Cracking Reaction Conduit: 650° C.

B. Temperature at Outlet of Thermal Cracking Reaction Conduit: 860° C.

C. Flow Rate of $C_4$ Fraction: 5 kg/hour

D. Flow Rate of Steam for Dilution: 2.5 kg/hour

TABLE 3

| | Amount of Carbon Deposition | | | | | | |
|---|---|---|---|---|---|---|---|
| | Inhibitor Element | | | | | | |
| Run Nos. | Na (wt %) | K (wt %) | Li (wt %) | Ca (wt %) | Ba (wt %) | Mg (wt %) | Amount of Carbon Deposition |
| 10 | 0.0012 | — | — | — | — | — | 6.0 |
| 11 | — | 0.006 | — | — | — | — | 5.9 |
| 12 | — | — | 0.002 | — | — | — | 5.6 |
| 13 | — | — | — | 0.025 | — | — | 7.0 |
| 14 | — | — | — | — | 0.01 | — | 7.1 |
| 15 | — | — | — | — | — | 0.03 | 6.8 |
| 16 | — | — | 0.002 | 0.025 | — | — | 5.5 |
| 17 (Comparative Example) | — | — | — | — | — | — | 12.9 |

The contents of Table 3 indicate the inhibitor element in terms of the metal component.

It is clear from Table 2 that the carbon deposition caused by the catalytically carbonizing action of nickel and iron can be suppressed by oxides such as $Na_2O$.

We claim:

1. A method for thermal cracking of or heating of hydrocarbons while suppressing carbon deposition on the surface of a heat-resistant alloy member of a thermal cracking or heating apparatus, characterized in that at least one element selected from the group consisting of an alkali metal, an alkaline earth metal, an alkali metal-oxide and an alkaline earth metal-oxide is incorporated, as a solid solution or dispersed phases, into at least part of said heat-resistant alloy member where carbon deposition occurs, thereby effectively suppressing the carbon deposition.

2. A method according to claim 1, wherein the inner surface of said thermal cracking or heating apparatus is metallic.

3. A method according to claim 1, wherein said heat-resistant alloy member consists of a nickel-chromium alloy.

4. A method according to claim 1, wherein said heat-resistant alloy member consists of a molybdenum-chromium alloy.

5. A method according to claim 1, wherein said heat-resistant alloy member consists of a nickel-chromium steel.

6. A method according to claim 1, wherein said heat-resistant alloy member consists of a chromium-molybdenum steel.

7. A method according to claim 1, wherein said heat-resistant alloy member consists of a cobalt alloy.

8. A method according to claim 1, wherein said alkali metal is at least one element selected from the group consisting of lithium, sodium and potassium and oxides thereof.

9. A method according to claim 1, wherein said alkaline earth metal is at least one element selected from the group consisting of calcium, barium, beryllium and magnesium and oxides thereof.

10. A method according to claim 9, wherein said alkaline earth metal is barium.

11. A method according to claim 9, wherein said alkaline earth metal is beryllium.

12. A method for thermal cracking of or heating of hydrocarbons while suppressing carbon deposition on the surface of a heat-resistant alloy member of a thermal cracking or heating apparatus, characterized in that a layer for suppressing carbon deposition is formed on the metallic surface of said heat-resistant alloy members, said layer comprising a mixture of a heat-resistant alloy and at least one element selected from the group consisting of an alkali metal, an alkaline earth metal, an alkali metal-oxide and an alkaline earth metal-oxide.

13. A method according to claim 12, wherein said layer for suppressing carbon deposition is formed by spraying.

14. A method according to claim 12 or 13, wherein said layer for suppressing carbon deposition further comprises an element having a catalytically carbonizing action.

15. A method according to claim 12, 13 or 14, wherein said alkali metal is at least one element selected from the group consisting of lithium, sodium and potassium.

16. A method according to claim 12, 13 or 14, wherein said alkaline earth metal is at least one element selected from the group consisting of calcium, barium, beryllium and magnesium.

17. A method according to claim 16, wherein said alkaline earth metal is barium.

18. A method according to claim 16, wherein said alkaline earth metal is beryllium.

* * * * *